US009591960B2

(12) United States Patent
Grove

(10) Patent No.: US 9,591,960 B2
(45) Date of Patent: Mar. 14, 2017

(54) SURFACE-CLEANING APPARATUS

(71) Applicant: TECHTRONIC FLOOR CARE TECHNOLOGY LIMITED, Tortola (VG)

(72) Inventor: Phil Grove, West Midlands (GB)

(73) Assignee: Techtronic Floor Care Technology Limited, Tortola (VG)

( * ) Notice: Subject to any disclaimer, the term of this patent is extended or adjusted under 35 U.S.C. 154(b) by 0 days.

(21) Appl. No.: 15/034,605

(22) PCT Filed: Feb. 7, 2014

(86) PCT No.: PCT/GB2014/050366

§ 371 (c)(1),
(2) Date: May 5, 2016

(87) PCT Pub. No.: WO2015/067920

PCT Pub. Date: May 14, 2015

(65) Prior Publication Data

US 2016/0256028 A1 Sep. 8, 2016

(30) Foreign Application Priority Data

Nov. 8, 2013 (GB) ..... 1319745.4

(51) Int. Cl.
*A47L 11/34* (2006.01)
*A47L 13/22* (2006.01)
(Continued)

(52) U.S. Cl.
CPC ..... *A47L 13/225* (2013.01); *A47L 9/068* (2013.01); *A47L 9/0693* (2013.01); *A47L 11/34* (2013.01); *A47L 13/258* (2013.01)

(58) Field of Classification Search
CPC ..... A47L 9/068; A47L 9/0693; A47L 11/34; A47L 13/225; A47L 13/258
See application file for complete search history.

(56) References Cited

U.S. PATENT DOCUMENTS

2004/0168281 A1 9/2004 Sako et al.
2011/0070015 A1* 3/2011 Teerlink ..... A47L 13/22 401/263

FOREIGN PATENT DOCUMENTS

CN 202269995 6/2012
EP 1600092 A2 11/2005
(Continued)

OTHER PUBLICATIONS

International Search Report, PCT/GB2014/050366, May 27, 2014.
United Kingdom Search Report for Application No. 1319745.4 dated Mar. 26, 2014 (1 page).

*Primary Examiner* — David Redding
(74) *Attorney, Agent, or Firm* — Michael Best & Friedrich LLP

(57) ABSTRACT

A surface cleaning apparatus including a cleaning head having a body to sit adjacent a first surface to be cleaned; and a head formation releasably connectable to a connection portion of the body; wherein in a first configuration the head formation is connected to the body such that the head formation sits adjacent the first surface or a second surface to be cleaned, and the cleaning head defines a first footprint, and in a second configuration the head formation is detached from the body and the cleaning head defines a second footprint.

15 Claims, 4 Drawing Sheets

(51) Int. Cl.
*A47L 9/06* (2006.01)
*A47L 13/258* (2006.01)

(56) References Cited

FOREIGN PATENT DOCUMENTS

| | | | |
|---|---|---|---|
| WO | 2012130123 | | 10/2012 |
| WO | 20120130123 | A1 | 10/2012 |

* cited by examiner

SURFACE-CLEANING APPARATUS

CROSS-REFERENCE TO RELATED APPLICATIONS

This application is a U.S. national phase of international application PCT/GB2014/050366, filed Feb. 7, 2014, which claims priority to U.K. Patent Application No. 1319745.4, filed Nov. 8, 2013, the entire contents of which are hereby incorporated by reference herein.

BACKGROUND

This invention relates to a surface cleaning apparatus. More particularly, but not exclusively, this invention relates to an apparatus for cleaning a surface such as a floor or wall which utilises a source of steam.

The use of steam cleaners for cleaning floor and other surfaces is well known. For cleaning floor surfaces, a steam cleaner typically has a cleaning head comprising a body able to be moved, by a user, over the surface to be cleaned, the body being adapted to carry a cleaning element of or including a fabric/textile or other material of a steam permeable absorbent nature. Steam (or very hot water) is emitted from the body and passes through the cleaning element to contact the surface being cleaned, with the effect of loosening dirt from the surface. Dirty water from condensation of the steam on the surface is absorbed by the cleaning element.

The cleaning head, to enable it to be manipulated over the surface being cleaned, may be attached to a wand and steam supplied thereto by way of a hose from a separate steam generator. Alternatively, the wand may itself be provided with a steam generator and supply of water, to form a self-contained steam cleaning device, sometimes referred to as a "stick" or "mop" type of steam cleaner.

A further provision known in such a steam cleaner is the ability to store a cleaning agent, e.g. a solution of a suitable detergent, to assist the cleaning operation.

SUMMARY

It should be appreciated that the invention is applicable to many other types of surface cleaning apparatus, for example, carpet washing apparatus/vacuums.

According to an aspect of the invention we provide a surface cleaning apparatus including a cleaning head having:

a body to sit adjacent a first surface to be cleaned; and a head formation releasably connectable to a connection portion of the body;

wherein in a first configuration the head formation is connected to the body such that the head formation sits adjacent the first surface or a second surface to be cleaned, and the cleaning head defines a first footprint, and in a second configuration the head formation is detached from the body and the cleaning head defines a second footprint.

According to a second aspect of the invention we provide a surface cleaning apparatus including a cleaning head having:

a body to sit adjacent a surface to be cleaned; and a head formation connected to the body;

wherein the head formation is moveable relative to the body between a first position in which the head formation sits adjacent the surface to be cleaned, and a second position in which the head formation is inclined to or spaced from the surface.

BRIEF DESCRIPTION OF THE DRAWINGS

Embodiments of the invention will now be described, by way of example only, with reference to the following figures, of which.

DETAILED DESCRIPTION

Figure 1:
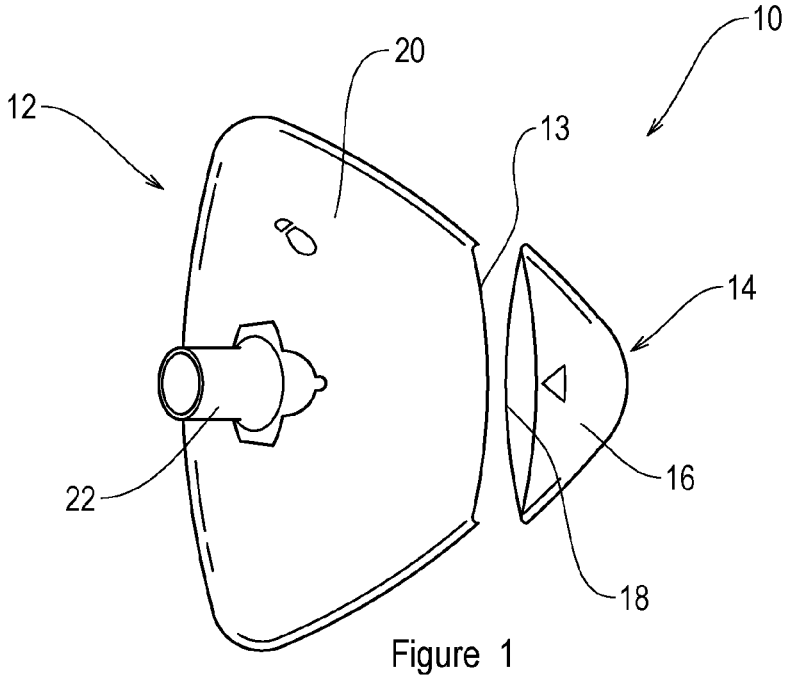
FIG. 1 is a top down illustration of a cleaning head according to embodiments of the invention, shown in its second configuration.

With reference to the drawings, a surface cleaning apparatus is provided, including a cleaning head 10 having a body 12 to sit adjacent a first surface to be cleaned, and a head formation 14 releasably connectable to a connection portion 13 of the body 12. The head formation 14 is defined by a head formation casing 16 forming an outer wall formed of a plastic material, or the like. When positioned adjacent a surface to be cleaned, the cleaning head 10 defines a footprint over that surface—in other words, the area of the surface that is covered by the cleaning head 10.

In embodiments, the head formation 14 is engageable with the connection portion 13 at a front-most position of the body 12. It should be understood that other configurations are also envisaged, and that the connection portion 13 may be provided at other positions on the body 12.

The cleaning head 10 includes a pad 17 of material that covers a portion of the footprint of the body 12. The material may be an abrasive material, such as a scouring pad, for example. The material may be absorbent, so that steam provided within the cleaning head 10 moistens the pad 17 to allow improved cleaning.

In embodiments, a second pad 19 of material covers a portion of the footprint of the head formation 14. That second pad 19 may comprise a different material to the first pad 17, so as to provide a portion of the cleaning head 10 with increased abrasive properties, or increased absorptive properties, or any other desirable properties.

The surface cleaning apparatus includes a fluid storage container. A further tank may be provided for storing a cleaning detergent, which may be mixed with fluid dispensed from the cleaning apparatus to enhance cleaning, or may alternatively be dispensed directly onto the surface being cleaned.

Figure 6:
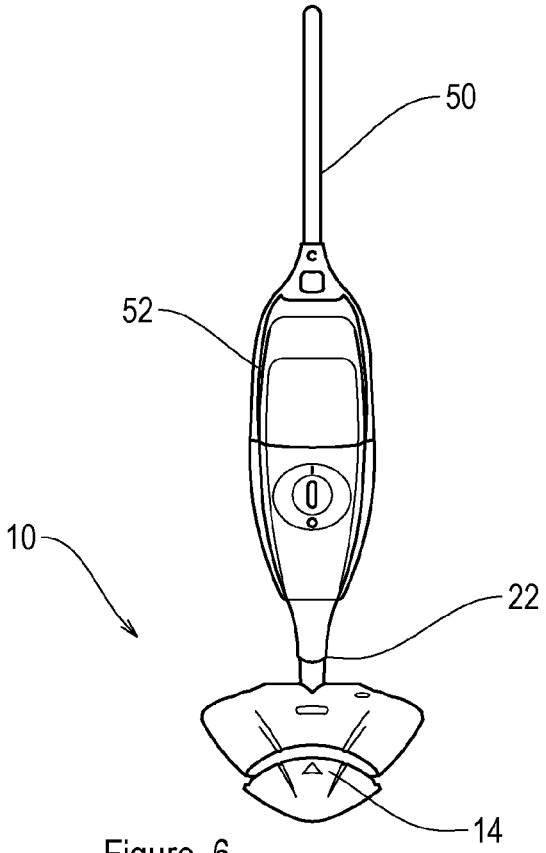
FIG. 6 is a front perspective view of a surface cleaning apparatus having a cleaning head according to an embodiment of the invention.

The body 12 of the cleaning head 10 provides a connection part 22 for connection to a body 52 of the surface cleaning apparatus. In embodiments, and as shown in FIG. 6, the apparatus includes a handle 50 that is graspable by a user for manoeuvring the apparatus over a surface.

In embodiments in which the apparatus is a steam-cleaning device, the fluid storage container is a water storage container. In such embodiments, the apparatus includes a steam generator including at least one heating element, the generator being in fluid communication with the water storage container. In embodiments, the apparatus includes a pump for feeding water from the water storage container to the steam generator, and a fluid passage for directing steam from the steam generator to the cleaning head 10 of the apparatus. In other embodiments the apparatus does not include a pump for feeding water from the storage container to the steam generator, relying instead on the effect of gravity to feed water from the storage container to the steam generator.

The cleaning head 10 defines a volume for receiving steam from the steam generator. The volume may be partially enclosed by the pad(s) 17, 19 provided on the body 12 and/or head formation 14 of the cleaning head 10. In embodiments, a single volume is defined between the body 12 and the head formation 14, wherein a skirt is provided between those two parts to limit the escape of steam through the connection between the two. In other embodiments, the head formation 14 defines a second volume for receiving steam from the steam generator, and the apparatus includes a further fluid passage for directing steam from the steam generator to the second volume.

Figure 2:
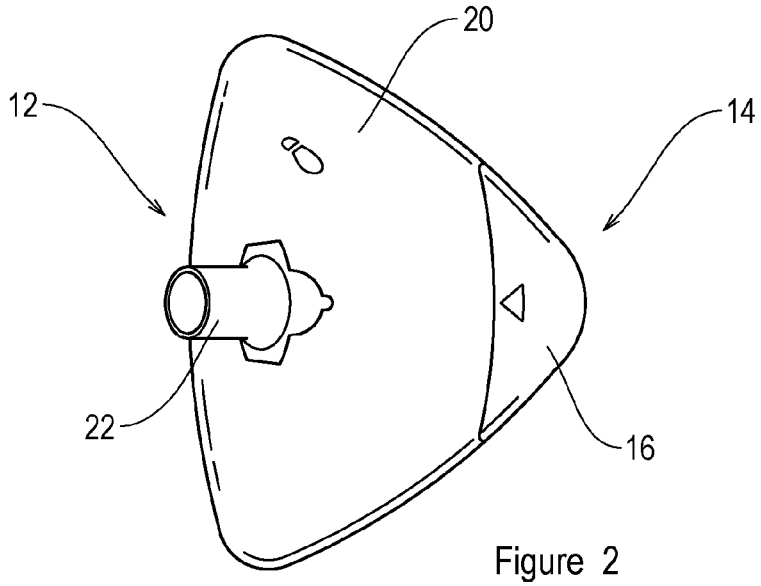
FIG. 2 is a top down illustration of the cleaning head of FIG. 1, shown in its first configuration.
Figure 3:
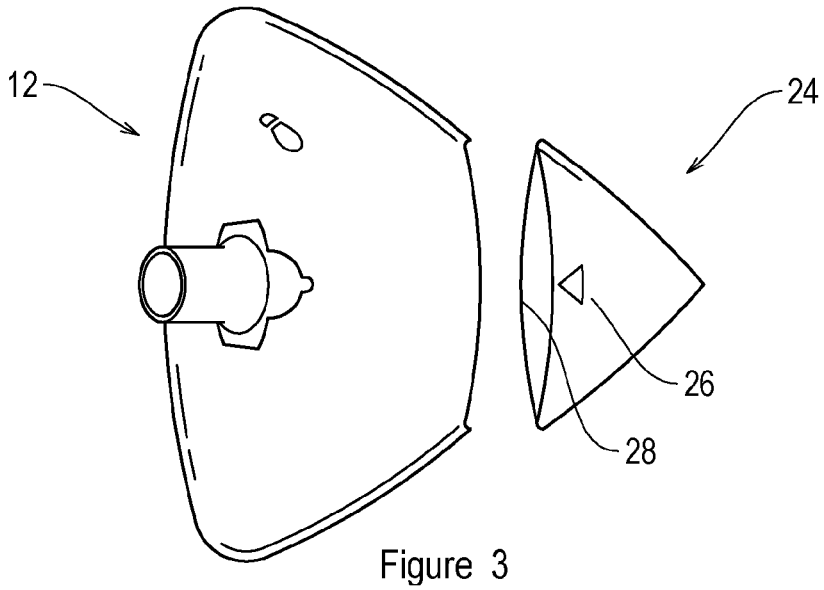
FIG. 3 is a top down illustration of a cleaning head according to an embodiment of the invention.
Figure 4:
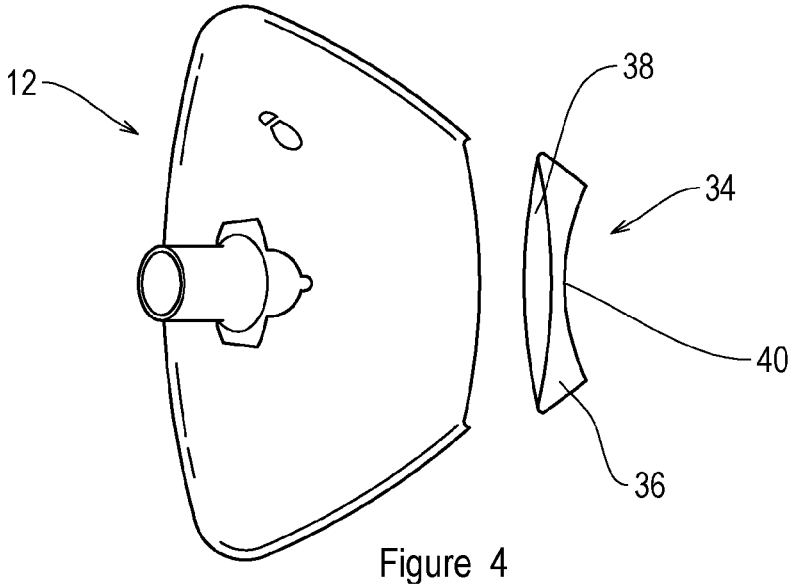
FIG. 4 is a top down illustration of a cleaning head according to an embodiment of the invention.
Figure 5:
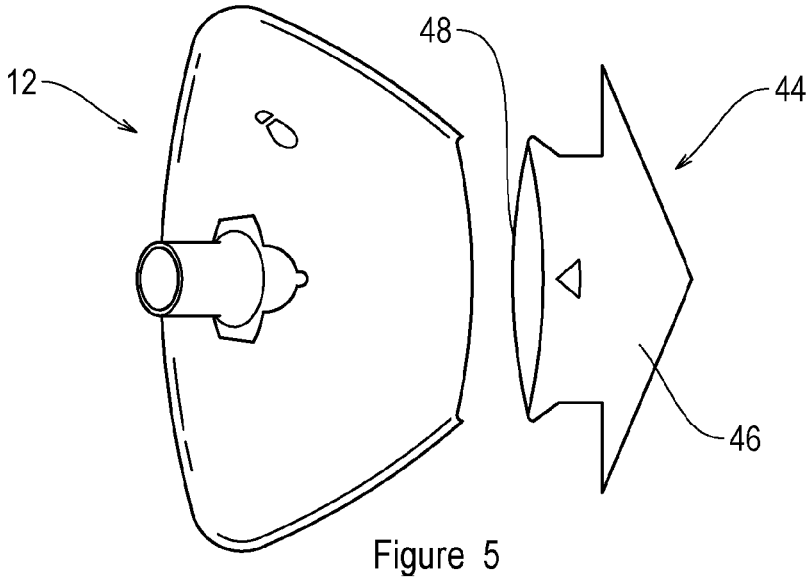
FIG. 5 is a top down illustration of a cleaning head according to an embodiment of the invention.

The cleaning head 10 may adopt a first configuration and a second configuration. In a first configuration, as shown in FIG. 2, the head formation 14 is connected to the body 12 such that both the head formation 14 and body 12 sit adjacent the first surface to be cleaned (i.e. the floor). In this configuration the cleaning head 10 defines a first footprint over the first surface (i.e. the floor). In embodiments, as described below, the head formation 14 may sit adjacent a second surface to be cleaned, such as the base of a wall underneath a cupboard, for example. In that example the cleaning head 10 defines a first footprint over a first and a second surface, the footprint being the combined portion of those surfaces adjacent the body 12 (i.e. the floor) and head formation 14 (i.e. a portion of a wall), respectively.

Figure 9:
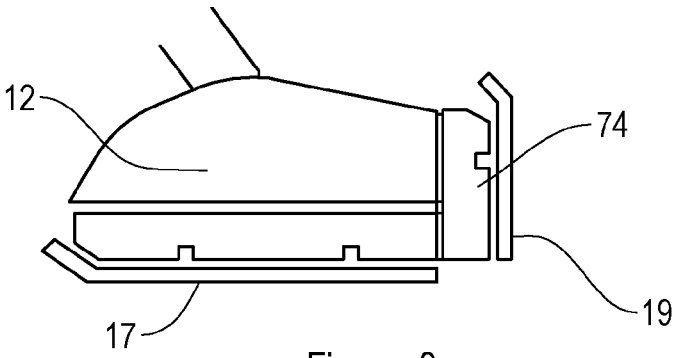
FIG. 9 is a diagrammatic side view showing a cleaning head in which the head formation faces a second surface.

In a second configuration, as shown in FIGS. 1 and 3 to 5, the head formation 14 is detached from the body 12 and the cleaning head 10 defines a second footprint. The second footprint has a smaller area than the first, since the footprint no longer includes the area of the head formation 14, whether that was formed on the first or on a second surface.

Where the head formation 14 faces the first surface—i.e. it provides an extension of the body of the cleaning head over the floor—in the first configuration the head formation 14 sits adjacent the first surface and the cleaning head 10 defines a first footprint adjacent the first surface (i.e. the floor), and in the second configuration the cleaning head 10 defines a second footprint, also adjacent the first surface (i.e. the floor).

Where the head formation 14 faces a second surface—in the case where the head formation 74 provides a cleaning surface perpendicular to that of the body 72 as shown in FIG. 9, for example—then in the first configuration the head formation 74 sits adjacent a second surface (i.e. a wall) and the cleaning head 70 defines a first footprint adjacent the first and second surfaces (i.e. a portion of the floor and a portion of the wall), and in the second configuration the cleaning head 70 defines a second footprint adjacent the first surface (i.e. over the floor only).

The cleaning apparatus is supplied with multiple different head formations 14, 24, 34, 44 each being connectable to the connection portion 13 of the body 12 as selected by a user. Each head formation 14, 24, 34, 44 is defined by a respective head formation casing 16, 26, 36, 46. Each head formation 14, 24, 34, 44 has a corresponding connection portion 18, 28, 38, 48 adapted for connection to the connection portion 13 of the body 12. A releasable securing formation may be provided on the head formation 14, or on the body 12, for securing the head formation 14 in position relative to the body 12, and enabling a user to release the head formation 14 from the body 12.

In embodiments, each of the head formations 14, 24, 34, 44 includes a pad 19 that covers a portion of the footprint of that head formation 14, 24, 34, 44, the pad 19 of each head formation 14, 24, 34, 44 having a different abrasiveness to the respective pads of the other head formations 14, 24, 34, 44. Alternatively, or additionally, each pad may have a different absorptiveness, or other property.

In embodiments, and as shown in FIGS. 1 to 5, the set of head formations 14, 24, 34, 44 may contain head formations 14, 24, 34, 44 of different shapes and/or sizes. The respective cleaning head 10 formed when each of those head formations 14, 24, 34, 44 is connected to the body 12 defines a footprint adjacent the surface(s) that differs from the respective footprints formed with the other head formations 14, 24, 34, 44. In other words, connecting a first head formation 14 to the body 12 creates a footprint of a different size and/or shape than connecting a second head formation 24 to the body 12. The differently-shaped head formations 14, 24, 34, 44 enable a user to select a particular head formation 14, 24, 34, 44 suitable for a particular cleaning task. For example, if the user wishes to clean a floor surface in a corner of a room, the user may select a substantially triangular head formation 24 that provides a pointed shape suitable for cleaning between right-angled corners. Alternative head formations 14, 34, 44 may provide shapes such as a smooth (convex) curved head formation 14, with no pointed edges (so as to avoid damaging furniture or walls, for example), or define a crescent-shaped recess 40 (in which case the footprint of the head formation 34 is substantially crescent-shaped) for cleaning around pillars, columns, furniture legs, poles, and the like, and novelty-shaped head formations 44 such as an arrow which may be supplied for promotional reasons, for example.

In embodiments, the body 12 includes a plurality of connection portions 13 each capable of being connected to a respective head formation 14. In this way, a cleaning head 10 may be modified with multiple head formations 14, 24, 34, 44 and adapted to clean different areas, or use different types of cleaning pad.

Figure 7:
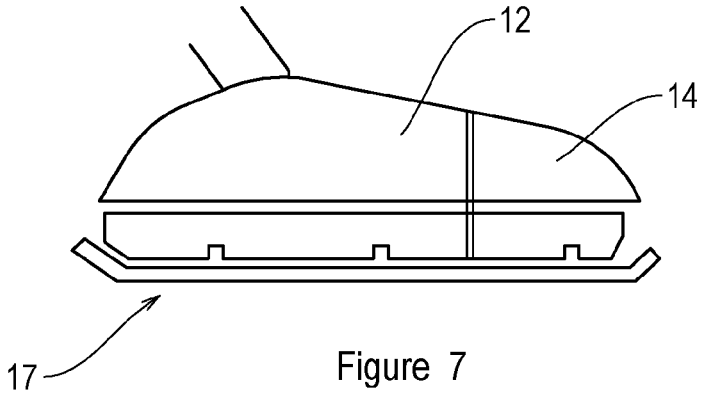
FIG. 7 is a diagrammatic side view showing a cleaning head according to embodiments of the invention.
Figure 8:
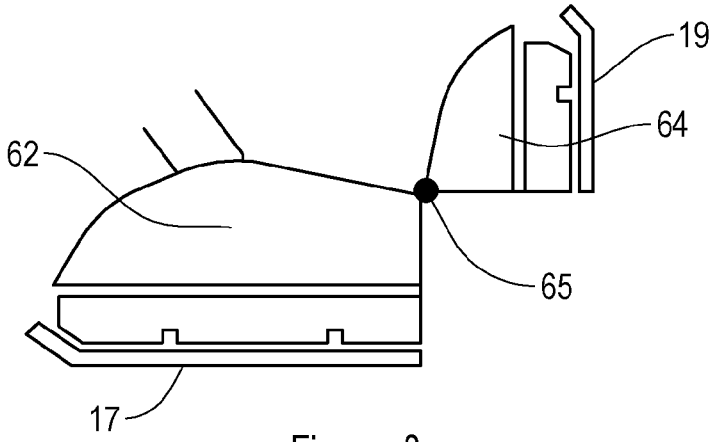
FIG. 8 is a diagrammatic side view showing a cleaning head in which the head formation is connected to the body by a pivot mechanism.

In other embodiments, and as shown in FIGS. 7 and 8, a surface cleaning apparatus includes a head formation 64 connected to the body 62, wherein the head formation 64 is moveable relative to the body 62 between a first position in which the head formation 64 sits adjacent the surface to be cleaned, and a second position in which the head formation 64 is inclined to or spaced from the surface (see FIG. 8). In embodiments, the head formation 64 is connected to the body 62 by a pivot mechanism 65, such as a hinge, for example. The head formation 64 may be generally upright in the second position, so that the head formation 64 pivots between a lowered position in which the head formation 64 faces the first surface (i.e. the floor) adjacent the body 62, and the second position in which the head formation 64 may be positioned to face a second surface such as a wall, generally upright in relation to the floor.

In embodiments, the apparatus includes a securing mechanism operable to secure the head formation 64 relative to the body 62 in one or both of the first and second positions. This enables a user to move the head formation 14 to the required position and then secure it in place.

In embodiments, the pivot mechanism is user operable by hand or foot and is positioned on the body 62 of the cleaning head 10, so that a user has easy access to the mechanism. The pivot mechanism may be moveable via a handle, or may be actuated by a lever or switch, for example.

In embodiments, the apparatus includes a wand/handle which in use is held by a user when operating the apparatus. In such embodiments the pivot mechanism may be user operable via a controller positioned on the handle or wand. The controller may be a graspable trigger that is mechanically linked to the pivot mechanism, for example.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A surface cleaning apparatus comprising:

a water storage container;

a steam generator in fluid communication with the water storage container, the steam generator including a heating element;

a cleaning head defining a volume for receiving steam from the steam generator, the cleaning head having a body to sit adjacent a first surface to be cleaned; and a head formation releasably connectable to a connection portion of the body; and a fluid passage for directing steam from the steam generator to the cleaning head;

wherein in a first configuration the head formation is connected to the body such that the head formation sits adjacent the first surface or a second surface to be cleaned, and the head formation defines at least part of the volume within the cleaning head for receiving steam from the steam generator, and the cleaning head defines a first footprint, wherein in a second configuration the head formation is detached from the body and the cleaning head defines a second footprint.

2. An apparatus according to claim 1, wherein in the first configuration the head formation sits adjacent the first surface and the cleaning head defines a first footprint adjacent the first surface, and in the second configuration the cleaning head defines a second footprint adjacent the first surface.

3. An apparatus according to claim 1, wherein in the first configuration the head formation sits adjacent a second surface and the cleaning head defines a first footprint adjacent the first and second surfaces, and in the second configuration the cleaning head defines a second footprint adjacent the first surface.

4. An apparatus according to claim 1, including a plurality of head formations each being connectable to the connection portion of the body as selected by a user.

5. An apparatus according to claim 4, wherein the cleaning head formed when each respective head formation is connected to the body defines a footprint adjacent the surface(s) that differs from the respective footprints formed with the other head formations.

6. An apparatus according to claim 4, wherein the body includes a plurality of connection portions each capable of being connected to a respective head formation.

7. An apparatus according to claim 4 wherein each of the head formations includes a pad that covers a portion of the footprint of that head formation, the pad of each head formation having a different abrasiveness to the respective pads of the other head formations.

8. An apparatus according to claim 1, wherein the first footprint is substantially triangular.

9. An apparatus according to claim 1, wherein the footprint of the head formation is substantially crescent-shaped.

10. An apparatus according to claim 1, wherein the head formation is engageable at a frontmost position of the body.

11. An apparatus according to claim 1, wherein the cleaning head includes a pad of material that covers a portion of the footprint of the body.

12. An apparatus according to claim 11, wherein the pad or another pad covers a portion of the footprint of the head formation.

13. An apparatus according to claim 11, wherein the pad(s) comprise(s) an absorbent material.

14. An apparatus according to claim 1, wherein the head formation defines a second volume for receiving steam from the steam generator, and wherein the apparatus includes a further fluid passage for directing steam from the steam generator to the second volume.

15. An apparatus according to claim 1, further including a pump for feeding water from the water storage container to the steam generator.

* * * * *